US009353656B2

(12) United States Patent
Bauer et al.

(10) Patent No.: US 9,353,656 B2
(45) Date of Patent: May 31, 2016

(54) PLATE HEAT EXCHANGER

(75) Inventors: Swen-Juri Bauer, Stuttgart (DE); Andreas Grüner, Hattenhofen (DE); Michael Neubauer, Waiblingen (DE)

(73) Assignee: Mahle International GmbH (DE)

( * ) Notice: Subject to any disclaimer, the term of this patent is extended or adjusted under 35 U.S.C. 154(b) by 502 days.

(21) Appl. No.: 13/496,309

(22) PCT Filed: Sep. 10, 2010

(86) PCT No.: PCT/EP2010/063319

§ 371 (c)(1),
(2), (4) Date: Mar. 15, 2012

(87) PCT Pub. No.: WO2011/032893

PCT Pub. Date: Mar. 24, 2011

(65) Prior Publication Data

US 2012/0175093 A1 Jul. 12, 2012

(30) Foreign Application Priority Data

Sep. 15, 2009 (DE) ..... 10 2009 041 524

(51) Int. Cl.

| | |
|---|---|
| ***F28F 3/08*** | (2006.01) |
| ***F28F 11/00*** | (2006.01) |
| ***F28F 9/22*** | (2006.01) |
| ***F28D 1/02*** | (2006.01) |
| ***F28F 3/00*** | (2006.01) |
| ***F01M 5/00*** | (2006.01) |
| ***F28D 9/00*** | (2006.01) |
| *F28D 21/00* | (2006.01) |

(52) U.S. Cl.
CPC ..... *F01M 5/002* (2013.01); *F28D 9/005* (2013.01); *F28D 2021/0089* (2013.01); *F28F 2225/00* (2013.01)

(58) Field of Classification Search
CPC ..... F28D 2021/0089; F28D 9/005; F28F 3/08
USPC ..... 165/167, 166, 70, 145, 153
See application file for complete search history.

(56) References Cited

U.S. PATENT DOCUMENTS 1,918,434 A * 7/1933 Stamsvik ..... 165/71
4,580,625 A * 4/1986 Yamanaka et al. ..... 165/167

(Continued)

FOREIGN PATENT DOCUMENTS

DE 19727145 A1 1/1999
DE 10333177 A1 2/2005

(Continued)

OTHER PUBLICATIONS

Translation of EP1788336A2 named TRANS-EP1788336A2.*

(Continued)

*Primary Examiner* — Alexandra Elve
*Assistant Examiner* — Paul Alvare
(74) *Attorney, Agent, or Firm* — Fishman Stewart PLLC

(57) ABSTRACT

A plate heat exchanger may include a plurality of trough-shaped heat exchanger plates stacked one on top of each other. Each plate may define a plurality of openings configured to receive a first fluid and a second fluid separated from the first fluid. An upper cover plate may have crossed embossed recesses aligned with and arranged on the openings of the heat exchanger plate in a sealed manner.

18 Claims, 2 Drawing Sheets

(56) References Cited

U.S. PATENT DOCUMENTS

| | | | | | |
|---|---|---|---|---|---|
| 4,781,248 | A * | 11/1988 | Pfeiffer | 165/167 |
| 4,987,955 | A * | 1/1991 | Bergqvist et al. | 165/167 |
| 5,307,869 | A * | 5/1994 | Blomgren | 165/167 |
| 5,492,171 | A * | 2/1996 | Kallrot | 165/167 |
| 7,337,836 | B1 * | 3/2008 | Persson | 165/167 |
| 8,590,607 | B2 * | 11/2013 | Demuth et al. | 165/167 |
| 2005/0284620 | A1 * | 12/2005 | Thunwall et al. | 165/167 |
| 2007/0023175 | A1 * | 2/2007 | Richter | 165/167 |
| 2007/0107890 | A1 * | 5/2007 | Geskes et al. | 165/167 |
| 2008/0257536 | A1 * | 10/2008 | Kolblin et al. | 165/167 |
| 2008/0264618 | A1 * | 10/2008 | Richter | 165/166 |

FOREIGN PATENT DOCUMENTS

| | | | |
|---|---|---|---|
| DE | 102005054728 | A1 | 5/2007 |
| DE | 102007011762 | A1 | 9/2008 |
| EP | 1788336 | A2 | 5/2007 |
| GB | 2056648 | A * | 3/1981 |
| GB | 2164439 | A * | 3/1986 |
| JP | S527055 | A | 1/1977 |
| JP | 2003097890 | A | 4/2003 |
| WO | WO-2005/038377 | A1 | 4/2005 |
| WO | WO-2005071342 | A1 | 8/2005 |

OTHER PUBLICATIONS

English translation of DE 10 2007 011 762 A1.
English translation of DE 10 2005 054 728 A1.
DE 197 27 145 A1—Abstract of equivalent European Application No. EP 0893667 A2.
Abstract of DE 103 33 177 A1.
Abstract of JP 2003 097890 A.
International Search Report PCT/EP2010/063319, dated Jun. 29, 2011.
English Abstract for JP S527055A.
Japanese Office Action for Application No. 2012-529221, dated Apr. 14, 2015, 7 pp.

* cited by examiner

PLATE HEAT EXCHANGER

CROSS-REFERENCE TO RELATED APPLICATIONS

This application claims priority to German Patent Application 10 2009 041 524.6 filed on Sep. 15, 2009 and PCT/EP2010/063319 filed on Sep. 10, 2010, which are hereby incorporated by reference in their entireties.

TECHNICAL FIELD

The present invention relates to a plate heat exchanger, in particular an oil cooler for an internal combustion engine, comprising several undulated heat exchanger plates which are stacked on top of each other.

BACKGROUND

From WO 2005/071342 A1 a generic plate heat exchanger is known, having a plurality of individual heat exchanger plates, which are joined to each other in a sealed manner, in particular are soldered to each other. As upper closure here a cover plate is provided, which on at least one site has a downwardly directed curvature or respectively recess and engages with this recess into an opening of a heat exchanger plate arranged beneath. A disadvantage in the presented prior art is, however, that the cover plate per se and in particular the recesses have only a comparatively poor stability.

The present invention is therefore concerned with the problem of providing for a plate heat exchanger of the generic type an improved or at least an alternative embodiment, which is distinguished in particular by an increased stability with respect to a cover plate.

SUMMARY

The present invention is based on the general idea of providing downwardly directed curvatures or respectively recesses on a cover plate of a plate heat exchanger with a crossed embossed geometry, so that the cover plate, in particular in the region of its downwardly directed recesses, which can be constructed in a complementary manner to openings of a heat exchanger plate arranged beneath, has a distinctly increased rigidity or respectively stability. The plate heat exchanger according to the invention, which can be constructed for example as an oil cooler for an internal combustion engine, has here in a known manner several trough-shaped heat exchanger plates which are stacked on top of each other, which have respectively several openings for a first fluid and a second fluid which is separate from the first, for example oil and cooling water. The upper cover plate now has the crossed embossed recesses according to the invention, which are preferably constructed in a complementary manner to the openings of the heat exchanger plate arranged beneath and at the same time can be joined in a sealed manner therewith, in particular soldered. By the crossed embossed recess, compared with a merely dome-shaped recess, there can be a distinctly increased stability, because the crossed embossed recess, in addition to curved forms in different directions, also has kinks or respectively edges, which increase the rigidity of the recess, in a similar manner to the case of body components for a motor vehicle. The crossed embossed recesses, just as the dome-shaped recesses known hitherto, can be produced here at a favourable cost and in a technically simple manner by means of an embossing or respectively deep-drawing process, but give the cover plate and hence the entire plate heat exchanger the desired greater rigidity.

In an advantageous further development of the solution according to the invention, the heat exchanger plates are constructed as deep-drawn sheet metal parts and have a wall thickness of approximately 0.5 mm. Deep-drawing is understood to mean a tensile compression deformation of a sheet metal blank into a hollow body which is open on one side, wherein generally a differentiation is made between a deep-drawing by tool and a deep-drawing by active fluid media, for example water. The deep-drawn heat exchanger plate presents in particular molecules which are moved with respect to each other, which leads to changes in stability and in particular also to increases in stability. Generally, the production of heat exchanger plates by means of deep-drawing methods is broadly known and also the deep-drawing of the crossed embossed recesses according to the invention is able to be realized comparatively simply and without involving cost. Depending on the embodiment or respectively the field of use, the wall thicknesses of the heat exchanger plates can vary here upwards to downwards from the mentioned 0.5 mm.

In an advantageous further development of the solution according to the invention, the crossed embossed recesses in the cover plate have a shape in the form of an elongated hole with a short crosspiece running orthogonally thereto. Such a geometric configuration offers a particularly high rigidity, wherein the shape of the recesses is of course adapted to the openings arranged beneath. It is of course also conceivable here that the length of the crosspiece, running to the shape of the recess in the form of an elongated hole, corresponds approximately to the width of the elongated hole or slightly more.

Further important features and advantages of the invention will emerge from the subclaims, from the drawings and from the associated description of figures with the aid of the drawings.

It shall be evident that the features mentioned above and to be explained further below are able to be used not only in the respectively indicated combination, but also in other combinations or in isolation, without departing from the scope of the present invention.

Preferred example embodiments of the invention are illustrated in the drawings and are explained in further detail in the following description, wherein identical reference numbers refer to identical or similar or functionally identical components.

BRIEF DESCRIPTION OF THE DRAWINGS

There are shown, respectively diagrammatically.

DETAILED DESCRIPTION

Figure 1:
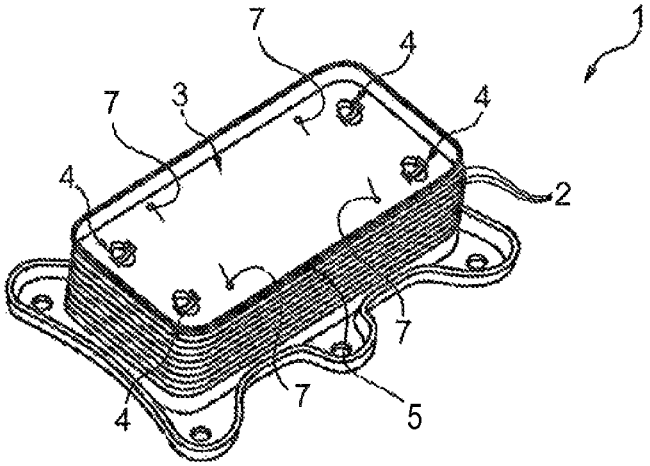
FIG. 1 a plate heat exchanger according to the invention.

In accordance with FIG. 1, a plate heat exchanger 1 according to the invention, in particular in the manner of an oil cooler for an internal combustion engine, has a plurality of trough-shaped heat exchanger plates 2, stacked on top of each other and joined to each other in a sealed manner. As upper closure, a cover plate 3 is provided. The individual heat exchanger plates 2 have here respectively several openings, which are not shown, and namely for a first fluid and a second fluid which is separate from the first, wherein the first fluid can be, for example, oil and the second fluid can be, for example coolant, in particular cooling water.

According to the invention, the upper cover plate 3 is now provided with crossed embossed recesses 4 (cf. also FIGS. 2 and 3), which can be constructed in a complementary manner to the openings of the heat exchanger plate 2 arranged beneath, and can be joined therewith in a sealed manner, in particular soldered. By the recesses 4 constructed in crossed embossed manner, these have a distinctly increased stability or respectively rigidity compared with hitherto known, in particular dome-shaped recesses, whereby the cover plate 3 and, with the latter, the entire plate heat exchanger 1 can be constructed so as to be distinctly more rigid.

The heat exchanger plates 2 are usually constructed as deep-drawn sheet metal parts and have a wall thickness of approximately 0.5 mm, whereas the cover plate 3 is likewise constructed as a deep-drawn sheet metal part, but usually has an at least slightly thicker wall thickness in the region of approximately 0.8 mm.

The openings provided in the heat exchanger plates 2, of which in accordance with FIG. 1 a total of four openings are provided, usually serve as oil- or coolant apertures between the individual heat exchanger plates 2. With a total of four provided openings, two thereof are reserved for the first fluid, for example oil, and two thereof for the second fluid, for example coolant. The individual heat exchanger plates are joined to each other here in a sealed manner, in particular soldered to each other, not only in the region of their openings, but also in addition on an outer edge 5.

Figure 2:
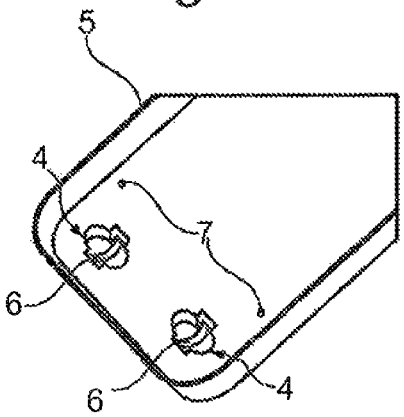
FIG. 2 a cover plate according to the invention with crossed embossed recesses in a view from obliquely above, FIG. 3 an illustration as in FIG. 2, but with a view from obliquely below, FIG. 4 an illustration as in FIG. 2, but with a different embodiment, FIG. 5 an illustration as in FIG. 4, but with a view from obliquely below.
Figure 3:
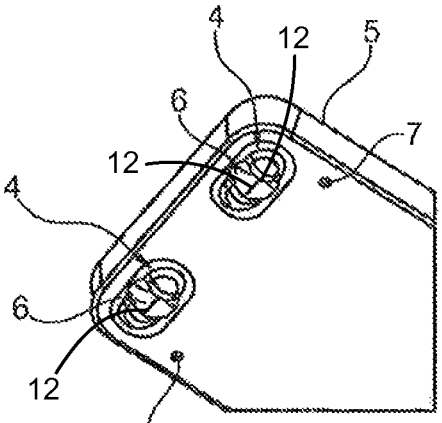

As can be seen from FIGS. 2 and 3, the crossed embossed recesses 4 in the cover plate 3 have a shape in the form of an elongated hole with a shorter crosspiece 6 running orthogonally thereto. The crosspiece 6 can have here approximately the width of the elongated hole of the recess 4 or can be slightly shorter or longer. Through the crosspiece 6, an edge formation 12 is brought about in the region of the recess 4, which in a similar manner to in body construction in motor vehicles increases the rigidity of the cover plate 3 in the region of the crossed embossed recesses 4. In addition, the cover plate 3 can have drainage bores 7, which guarantee a higher reliability of operation.

Figure 4:
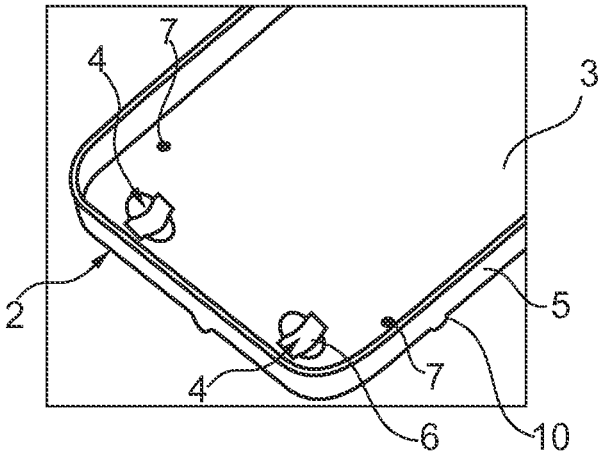
Figure 5:
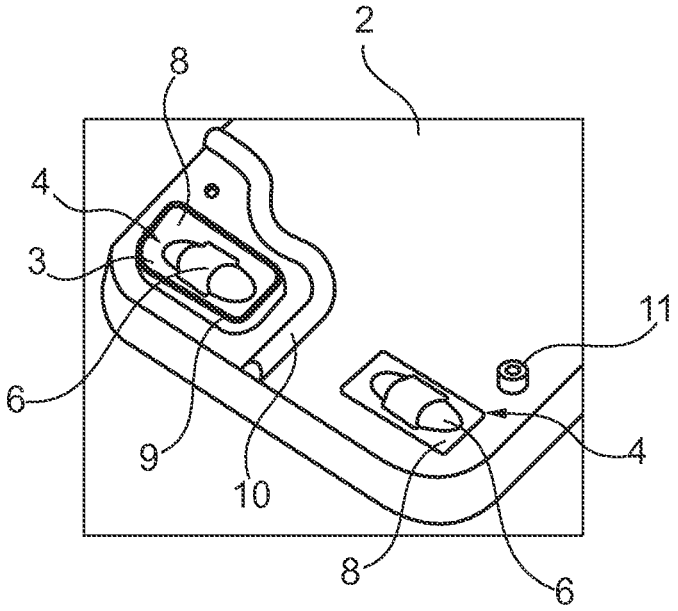

According to FIGS. 4 and 5, embodiments are shown in which the crossed embossed recesses 4 of the cover plate 3 are constructed in a complementary manner to coolant openings 8 of the heat exchanger plate 2 lying beneath and are joined therewith in a sealed manner, in particular soldered. At the same time here the at least one of the coolant openings 8, here the coolant opening 8', is surrounded by a first bead 9 and a second bead 10, which bring about a separation of the two media in the plate heat exchanger 1. At the same time, at particular drainage bores, a nozzle 11 is formed, which likewise prevents an undesired mixing of the two media, for example water and oil, used in the plate heat exchanger 1.

As a whole, a distinct increase in the rigidity or respectively stability can be achieved with the cover plate 3 constructed according to the invention, without additional work with regard to construction and in particular without additional cost.

The invention claimed is:

1. A plate heat exchanger comprising;

a plurality of trough-shaped heat exchanger plates stacked one on top of each other, wherein each of the plurality of plates define a plurality of openings for receiving a first fluid and a second fluid separated from the first fluid, a cover plate mounted on the plurality of plates and having a plurality of crossed embossed recesses with a profile that is complementary to the plurality of openings and said recesses projecting in a direction towards the plurality of plates, the crossed embossed recesses are aligned with and arranged on the plurality of openings, thereby mounting the cover plate to the plurality of plates in a sealed manner;

at least one of the plurality of openings of the plurality of plates is surrounded by a first bead and a second bead that separate the first fluid from the second fluid in the plate heat exchanger;

wherein each of the plurality of recesses in the cover plate defines a shape in the form of an elongated hole having a width and a length that is orthogonal to the width, the length of the hole being greater than the width of the hole, and a plurality of crosspieces associated with the plurality of recesses, wherein the plurality of crosspieces extend across their respective recess in a direction that is orthogonal to the length of the hole and beyond a periphery of the elongated hole.

2. The plate heat exchanger according to claim 1, wherein the heat exchanger plates are constructed as deep-drawn sheet metal parts and have a wall thickness of approximately 0.5 mm.

3. The plate heat exchanger according to claim 1, wherein the cover plate is constructed as a deep-drawn sheet metal part and has a wall thickness of approximately 0.8 mm.

4. The plate heat exchanger according to claim 1, wherein the plurality of openings are constructed as oil or coolant apertures.

5. The plate heat exchanger according to claim 1, wherein each heat exchanger plate defines at least four openings, wherein two of the at least four openings are configured to receive the first fluid and another two of the at least four openings are configured to receive the second fluid.

6. The plate heat exchanger according to claim 1, wherein the cover plate is joined and arranged directly above at least one heat exchanger plate in a sealed manner to an outer edge.

7. The plate heat exchanger according to claim 1, wherein the upper cover plate is soldered to the heat exchanger plate.

8. The plate heat exchanger according to claim 2, wherein the cover plate is constructed as a deep-drawn sheet metal part and has a wall thickness of approximately 0.8 mm.

9. The plate heat exchanger according to claim 8, wherein the openings are constructed as at least one oil and coolant apertures.

10. The plate heat exchanger according to claim 2, wherein each heat exchanger plate defines at least four openings, wherein two of the at least four openings are configured to receive the first fluid and another two of the at least four openings are configured to receive the second fluid.

11. The plate heat exchanger according to claim 2, wherein the cover plate is joined and arranged directly above at least one the heat exchanger plate in a sealed manner to an outer edge.

12. The plate heat exchanger according to claim 1, wherein a portion of the upper plate that is disposed between the first and second beads has a drainage hole formed therethrough, and the drainage hole is configured to drain the first fluid leaking through the first bead and the second fluid leaking through the second bead.

13. The plate heat exchanger according to claim 1, wherein the at least one crosspiece has a length and a width orthogonal to the length, the length of the at least one crosspiece spanning the extent of the at least one recess, and wherein the at least one crosspiece projects outwardly in a direction towards the plurality of plates.

14. The plate heat exchanger according to claim 13, wherein the at least one crosspiece has a profile on a side facing the plurality of plates interrupted by at least one edge formation, and wherein the at least one edge formation extends transverse to the length of the at least one crosspiece.

15. The plate heat exchanger according to claim 1, wherein the at least one crosspiece is contiguous with the at least one recess.

16. A plate heat exchanger, comprising;

a plurality of plates stacked one on top of another, the plurality of plates respectively including a plurality of through-openings for receiving a first fluid and a second fluid separated from the first fluid;

a cover plate mounted on the plurality of plates and including a plurality of crossed embossed recesses corresponding to the plurality of through openings, the plurality of recesses each respectively including a cross-section defined by a length and a width orthogonal to the length, the length being greater than the width, wherein the plurality of recesses project from the cover plate in a direction towards the plurality of plates; and a plurality of crosspieces extending along the plurality of recesses, the plurality of crosspieces traversing the width of the plurality of recesses and extending beyond a periphery of the plurality of recesses, wherein at least one crosspiece is profiled to define at least one edge formation on a side facing away from the extension of the at least one recess;

wherein the plurality of recesses engage the corresponding plurality of through-openings of the plurality of plates, thereby mounting the cover plate to the plurality of plates in a sealed manner.

17. The plate heat exchanger according to claim 16, wherein the crosspiece has a length and a width orthogonal to the length, and wherein the length of the crosspiece corresponds to the width of the at least one recess and the width of the crosspiece is less than the length of the at least one recess.

18. The plate heat exchanger according to claim 17, wherein the at least one edge formation extends along the width of the crosspiece and transverse to the length of the crosspiece.

* * * * *